US007213431B1

(12) United States Patent
Hsu

(10) Patent No.: US 7,213,431 B1
(45) Date of Patent: May 8, 2007

(54) METHOD OF MANUFACTURING AN ALUMINUM ALLOY WHEEL

(75) Inventor: Yung-Chen Hsu, Taoyuan (TW)

(73) Assignee: Evergreat Intl Co., Ltd., Binh Duong Province (VN)

( * ) Notice: Subject to any disclaimer, the term of this patent is extended or adjusted under 35 U.S.C. 154(b) by 0 days.

(21) Appl. No.: 11/344,136

(22) Filed: Feb. 1, 2006

(51) Int. Cl.
*B21K 1/38* (2006.01)

(52) U.S. Cl. ..... 72/175; 72/168; 72/169; 72/173; 29/894.354

(58) Field of Classification Search ..... 72/133, 72/168, 169, 175, 173, 171, 166, 229, 365.2, 72/369; 29/894.354, 894.35
See application file for complete search history.

(56) References Cited

U.S. PATENT DOCUMENTS 1,773,566 A * 8/1930 Boyle, Jr. ..... 228/152
4,054,982 A * 10/1977 Damman ..... 29/894.35
4,164,133 A * 8/1979 Damman ..... 72/12.5
4,185,370 A * 1/1980 Evans ..... 29/894.354
4,266,417 A * 5/1981 Imamura et al. ..... 72/168
4,304,114 A * 12/1981 Wiig ..... 72/130
4,589,177 A * 5/1986 Secolo et al. ..... 29/894.354
5,970,770 A * 10/1999 Caporusso et al. ..... 72/175
6,769,597 B1 * 8/2004 Seizu ..... 228/152

* cited by examiner

*Primary Examiner*—Dmitry Suhol
(74) *Attorney, Agent, or Firm*—Bacon & Thomas, PLLC

(57) ABSTRACT

A method of manufacturing an aluminum alloy wheel, comprising the steps of producing an elongated strip of alloy blank with a desired cross-section by squeezing an alloy material, pre-curving the two ends of said blank into arcs, placing one end of said blank between an upper main roller and a lower main roller of a rolling machine to hold said blank, when said blank is being held by said upper main roller and said lower main roller and being driven back and forth along the longitudinal direction, approaching two auxiliary rollers of said rolling machine toward the two sides of said upper main roller to push said blank, so that said blank follows the curve established by a holding point between said upper main roller and said lower main roller and pushing points of said auxiliary rollers to progressively coil into the shape of the desired aluminum alloy wheel.

12 Claims, 12 Drawing Sheets

METHOD OF MANUFACTURING AN ALUMINUM ALLOY WHEEL

FIELD OF THE INVENTION

The present invention relates to a method of manufacturing an aluminum alloy wheel and more particularly to a method which is low in cost, simple while flexible and safe in operation.

BACKGROUND OF THE INVENTION

With progress in technologies and economy and the ever-decreasing costs in automobile manufacturing and selling prices, popularity in motor vehicles has increased drastically in recent years. This not only brings convenience to people but also shortens the distances among them, satisfying the human needs for transportation. After years of research and design efforts by the manufacturers, the material used in wheels for motor vehicles has advanced from iron to aluminum, which provides lighter weight and a more appealing appearance. The progress in automobile wheel making not only improved the performance and running distance of vehicles, it also elevated the automobile industry to a higher technical realm. To obtain a leading position, all manufacturers are directing their focus in wheel manufacturing and design toward lower costs, better quality and faster production.

A prior method of producing aluminum alloy wheels is by die-casting. A large scale machine with a built-in wheel forming die is used. Melted liquid metal is cast and filled into the die. When said liquid metal cools and hardens in said die, the die is then opened to obtain a semi-finished aluminum wheel. However, with this procedure, air is likely to be trapped in the cast aluminum, resulting in air leakage and affecting safety.

In addition to the safety issue, a main drawback in said die-casting wheel manufacturing procedure is that it requires a high processing cost. Both the die and the large scale machine are very expensive and a large scale suspension system has to be installed in the factory to incorporate said wheel forming die. To remove or replace a forming die, a hoist might even be required. Therefore the prior method not only consumes substantial amount of time and takes up huge space, but also creates safety issues in the process. Those problems become even more obvious when producing larger sized wheels.

As a result, some manufacturers developed other methods of manufacturing aluminum alloy wheels. U.S. Pat. No. 4,589,177 by Secolo et al. and U.S. Pat. No. 4,185,370 provides examples of those methods. Refer to FIGS. 1–3. A flat strip 10 of aluminum alloy is first produced and then said strip 10 is bent to form a circle so that the two ends of said strip 10 are close to each other and form a small weld line 100. The weld line 100 is then welded to form said strip 10 into a hoop 12. Said hop 12 then undergoes a sequence of deformation steps by pressing rollers with different die shapes on said hoop 12 to gradually form the desired cross-sectional profile and obtain a semi-finished aluminum alloy wheel 14.

In said conventional manufacturing process, numerous sets of rollers with various shapes of dies must be utilized to sequentially press on said flat-profiled hoop 12 so that the desired cross-sectional profile on said aluminum alloy wheel 14 can be achieved. This kind of process presents several drawbacks. First, purchase and installation of many sets of expensive rollers calls for a substantial raise in cost. Secondly, the deformation process using sets of rollers with different die shapes notably increases the complexity of the working cycle, thus brings extra overheads in operation time, manpower and energy consumption. Moreover, said rolling deformation performed on said flat-profiled hoop 12 could easily create an uneven pressure during the deformation process, causing an unbalanced weight or a low hardness on the resulting aluminum alloy wheel 14, which will significantly reduce the life time of said conventionally made aluminum alloy wheel 14.

SUMMARY OF THE INVENTION

After considerable research and experimentation, a method of manufacturing an aluminum alloy wheel according to the present invention has been developed so as to overcome the drawbacks of high costs, a complex working cycle, requirement of sizeable factory space and low product quality associated with said prior methods in manufacturing an aluminum alloy wheel.

It is an object of the present invention to provide a method of manufacturing an aluminum alloy wheel comprising the steps of, according to the desired cross-sectional profile of said wheel, producing an elongated strip of alloy blank by squeezing a first alloy material, pre-curving the two ends of said blank into arcs, placing one end of said blank between an upper main roller and a lower main roller of a rolling machine to hold said blank, the outer edge profile of said upper main roller and said lower main roller matching the inner edge profile and outer edge profile respectively, when said blank is being held by said upper main roller and said lower main roller and being driven back and forth along the longitudinal direction, approaching two auxiliary rollers of said rolling machine toward the two sides of said upper main roller to push said blank, said two auxiliary rollers having an outer edge profile matching the outer edge profile of said blank, so that said blank follows the curve established by a holding point between said upper main roller and said lower main roller and pushing points of said auxiliary rollers to progressively coil into the shape of the desired aluminum alloy wheel, and welding the weld line between the joining two ends of said coiled blank.

It is another object of the present invention to provide a method of manufacturing an aluminum alloy wheel wherein when the arc at one end of said blank is placed onto said holding point, approach said two auxiliary rollers toward said upper main roller from the sides of said main roller until the outer edges of said auxiliary rollers cross a tangent line formed at said holding point, then drive said main rollers simultaneously to roll toward one side of said main rollers and to drive said end of said blank to pass between said main rollers so that said arc of said end makes contact with the outer edge of one of said auxiliary rollers and is continuously bent toward said upper main roller along the outer edge of one of said auxiliary rollers, when the arc at the other end of said blank moves between said main rollers, then drive said main rollers simultaneously to roll toward the other side of said main rollers and to drive the other end of said blank to pass between said main rollers so that the arc of said other end makes contact with the outer edge of the other auxiliary roller and is continuously bent toward said upper main roller along the outer edge of one of said other auxiliary roller, repeatedly drive said main rollers in said manner and approach said two auxiliary rollers progressively so that said blank is pushed by said rollers and is continuously bent to form the shape of said desired aluminum alloy wheel.

The above and other objects, features and advantages of the present invention will become apparent from the following detailed description taken with the accompanying drawings.

DETAILED DESCRIPTION OF THE PREFERRED EMBODIMENTS

Figure 1:
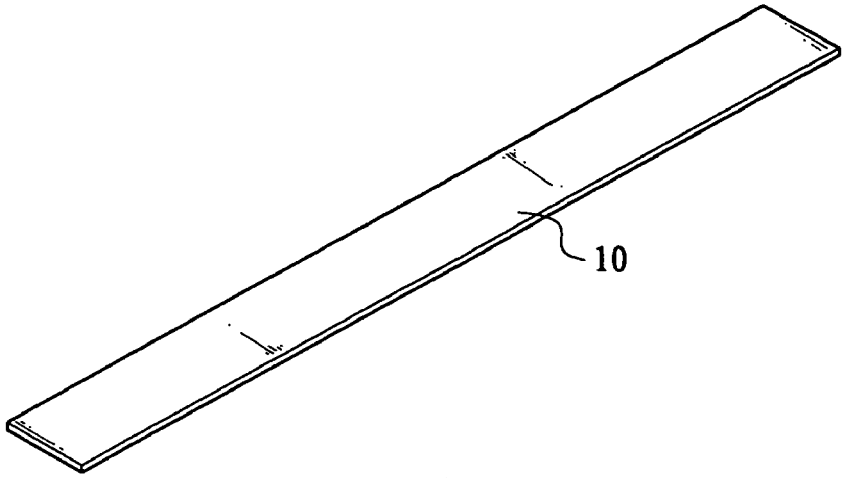
FIG. 1 (Prior Art)
FIG. 1 is a perspective view of a flat strip of aluminum alloy according to a prior method of manufacturing an aluminum alloy wheel.
Figure 2:
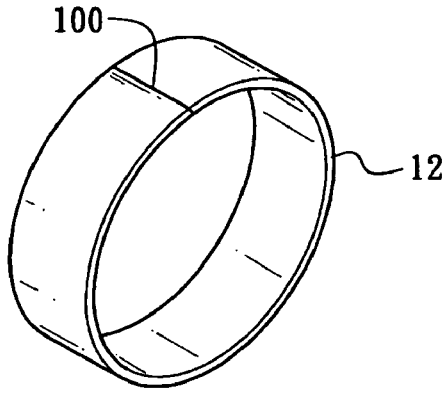
FIG. 2 (Prior Art)
FIG. 2 shows a semi-finished aluminum alloy wheel in said prior method of manufacturing an aluminum alloy wheel.
Figure 3:
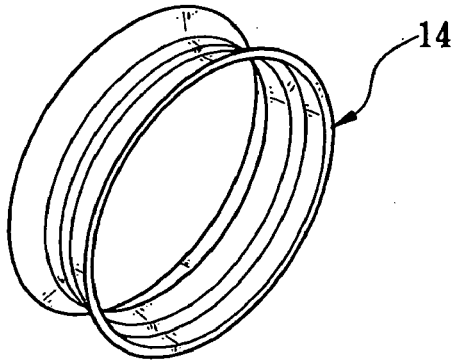
FIG. 3 (Prior Art)
FIG. 3 shows an aluminum alloy wheel made from said prior method of manufacturing an aluminum alloy wheel.
Figure 4:
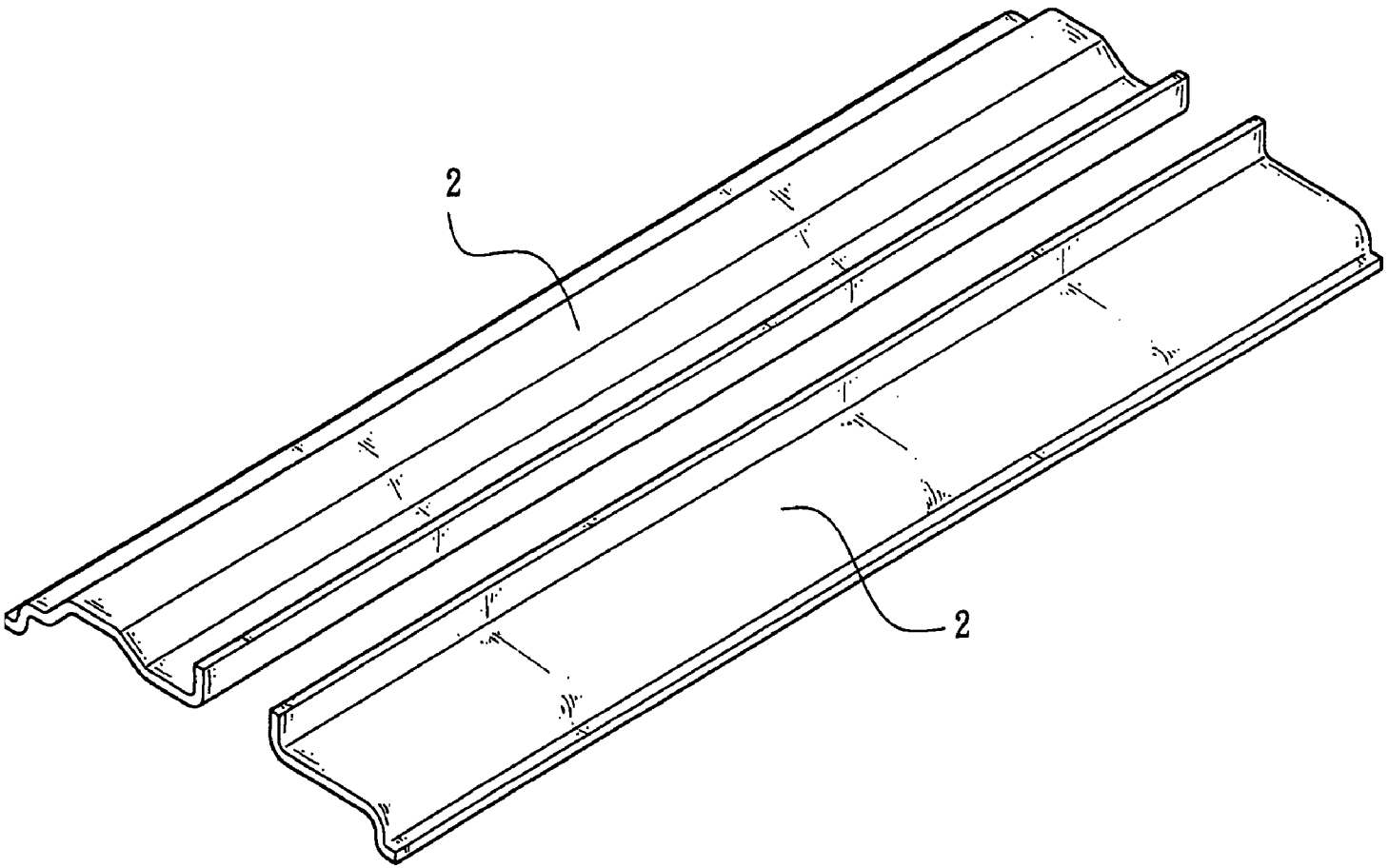
FIG. 4 shows an elongated strip of alloy blank produced by squeezing a first alloy material according to the present invention.
Figure 5:
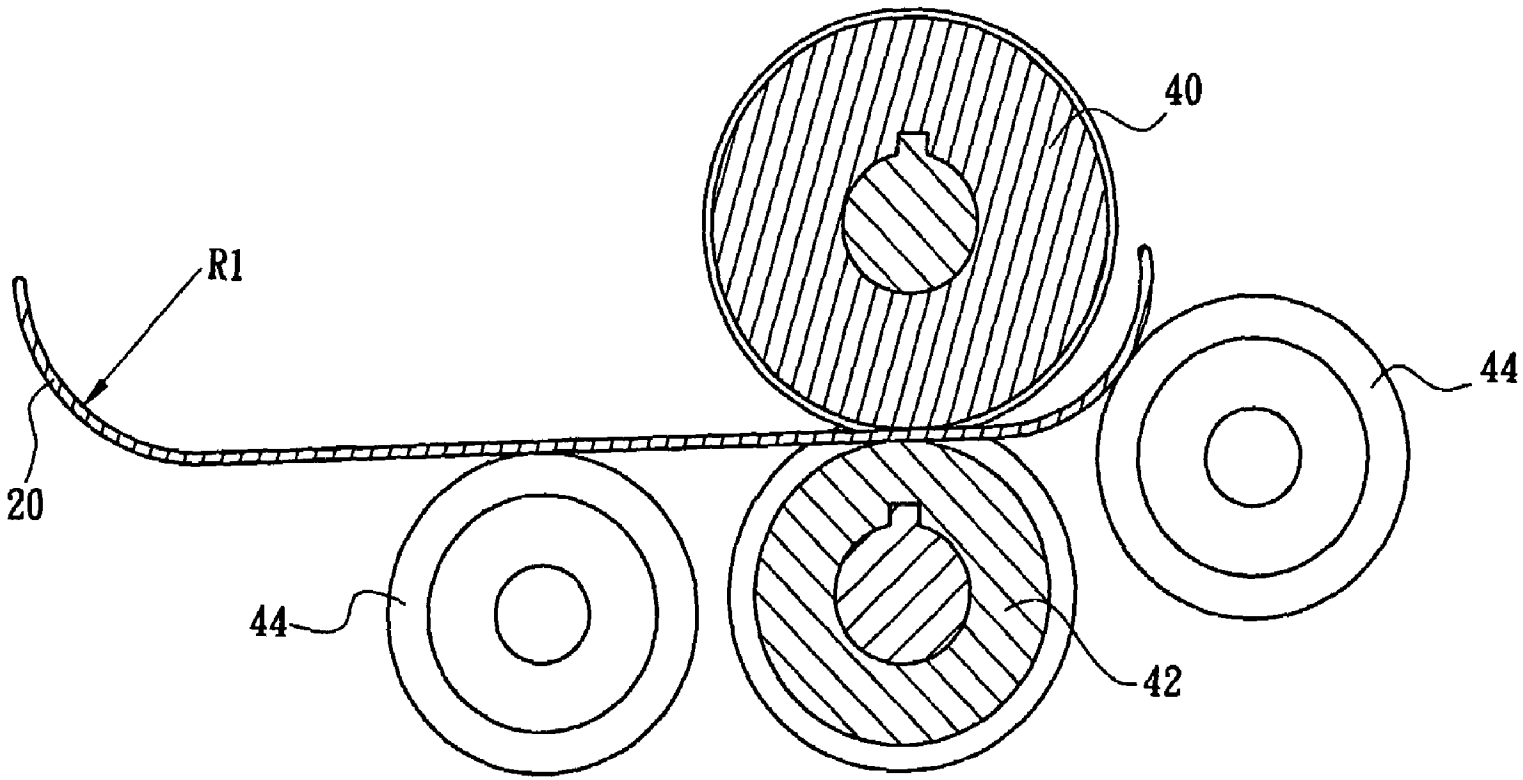
FIG. 5 is a perspective view showing said blank being pre-curved according to the present invention.

The present invention is a method of manufacturing an aluminum alloy wheel. Refer to FIG. 4 to FIG. 12. First, according to the desired cross-sectional profile of said aluminum alloy wheel, produce an elongated strip of alloy blank 2 by squeezing an alloy material. Then pre-curve near the two ends of said blank into arcs 20, then place one end of said blank between an upper main roller 40 and a lower main roller 42 of a rolling machine to hold said blank 2. The outer edge profile of said upper main roller 40 and the outer edge of said lower main roller 42 match the inner edge profile and outer edge profile of said desired aluminum alloy wheel, respectively. When said blank 2 is being held by said upper main roller 40 and said lower main roller 42 and being driven back and forth along the longitudinal direction, approach two auxiliary rollers 44 of said rolling machine toward the two sides of said upper main roller 40 to push said blank 2. Said two auxiliary rollers 44 have an outer edge profile matching the outer edge profile of said desired aluminum alloy wheel. Said blank 2 is pushed by said two auxiliary rollers 44 so that said blank 2 follows the curve 50 established by a holding point 54 between said upper main roller 40 and said lower main roller 42 and pushing points 56 of said auxiliary rollers to progressively coil into the shape of said desired aluminum alloy wheel. Finally, weld the weld line 22 between the opposing two ends of said blank 2 when the two ends of said blank 2 join each other to obtain a semi-finished aluminum alloy wheel 3.

Refer to FIG. 4 to FIG. 7 for a preferred embodiment of the present invention. After said blank 2 is squeezed, one end of said blank 2 is held between said upper main roller 40 and said lower main roller 42, and one of said two auxiliary rollers 44 approaches said upper main roller 40. Said main rollers then drive said blank 2 to pass said end between said main rollers toward said auxiliary roller 44, said end of said bank 2 is thereby pushed by said upper main roller 40, said lower main roller 42 and said auxiliary roller to form one of said desired arc 20. Then drive said blank 2 in the other direction so that the other end of said blank 2 is held between said upper main roller 40 and said lower main roller 42. Said blank 2 then is driven to pass said other end toward the other auxiliary roller 44 to form the other arc 20. Repeat the above-mentioned steps to complete the pre-curving of said blank 2.

Figure 6:
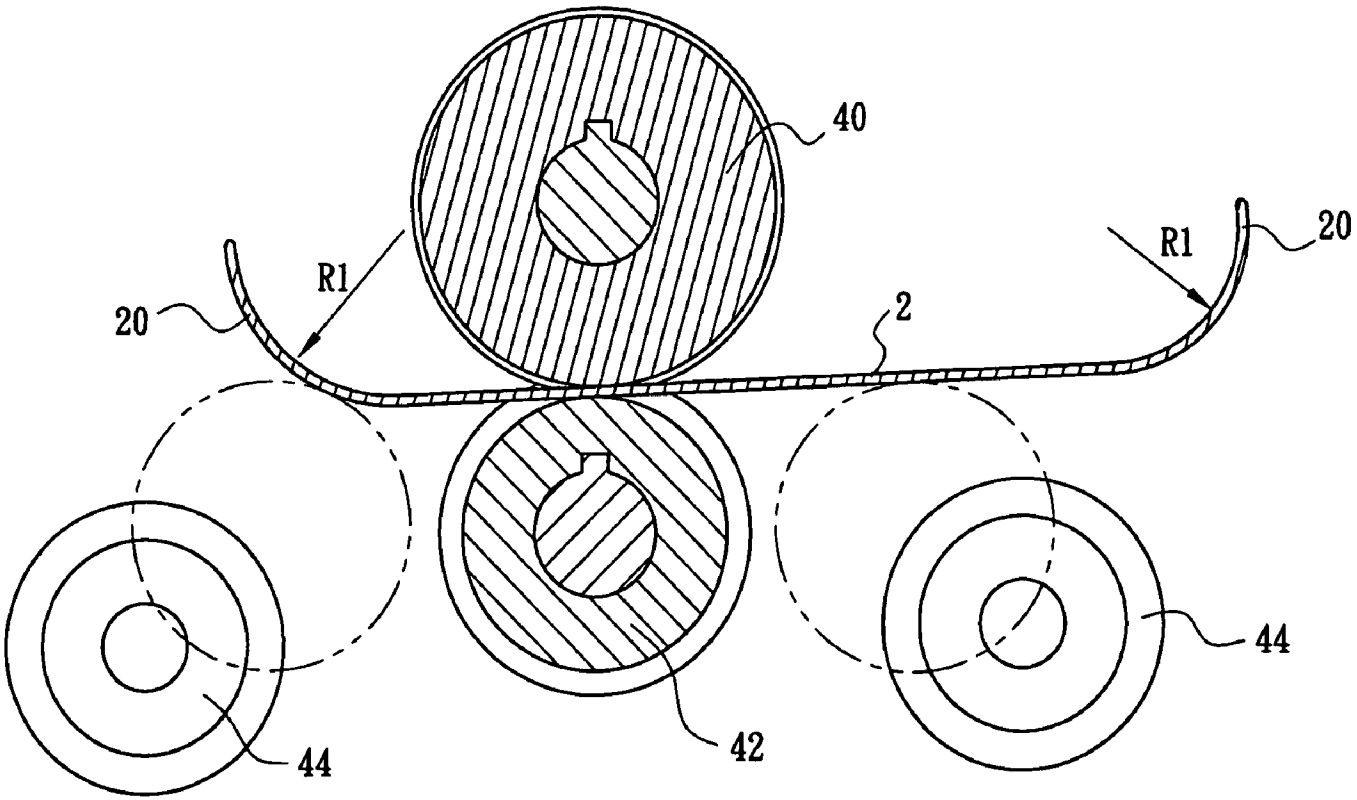
FIG. 6 is another perspective view showing said blank being pre-curved according to the present invention.
Figure 7:
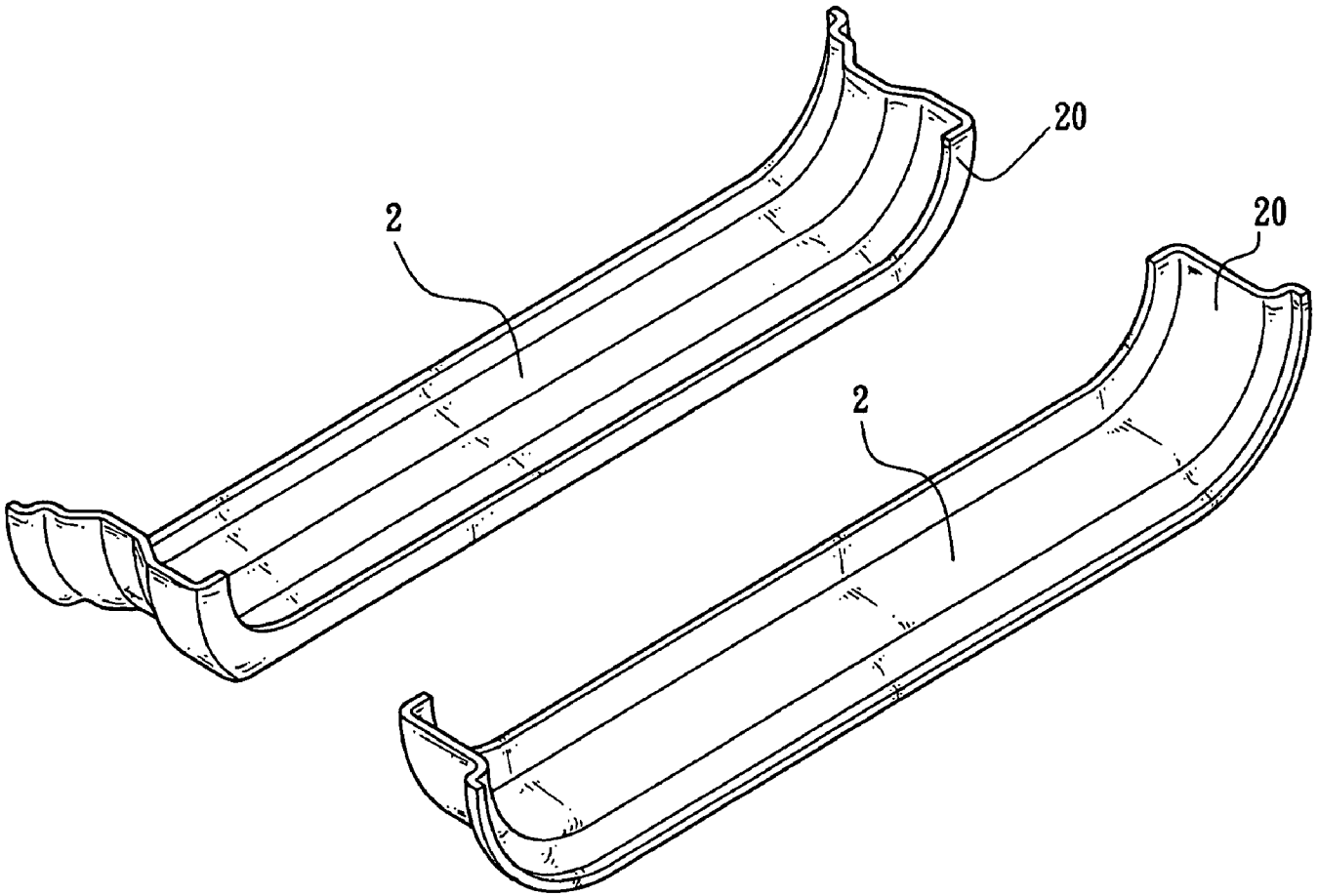
FIG. 7 shows a pre-curved blank according to the present invention.

Refer to FIG. 6 for said preferred embodiment of the present invention. The radius R1 of said arc is slightly bigger than or at least equal to the radius R2 of said desired aluminum alloy wheel thereby when the two ends of said blank 2 join each and form a weld line 22, said arc 20 forms a continuous curve with the portion on said blank 2 which is coiled by said main rollers 40, 42 and said auxiliary roller 44 and said blank 2 as a whole coil into the shape of the desired aluminum alloy wheel.

Figure 8:
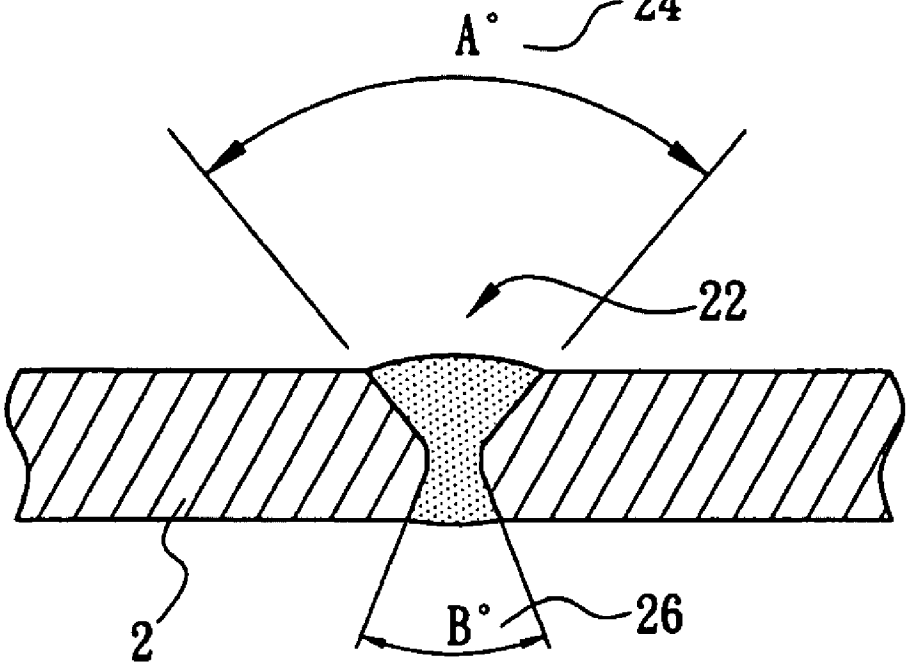
FIG. 8 is a perspective view showing a weld line with an inner and an outer guide angle according to the present invention.
Figure 9:
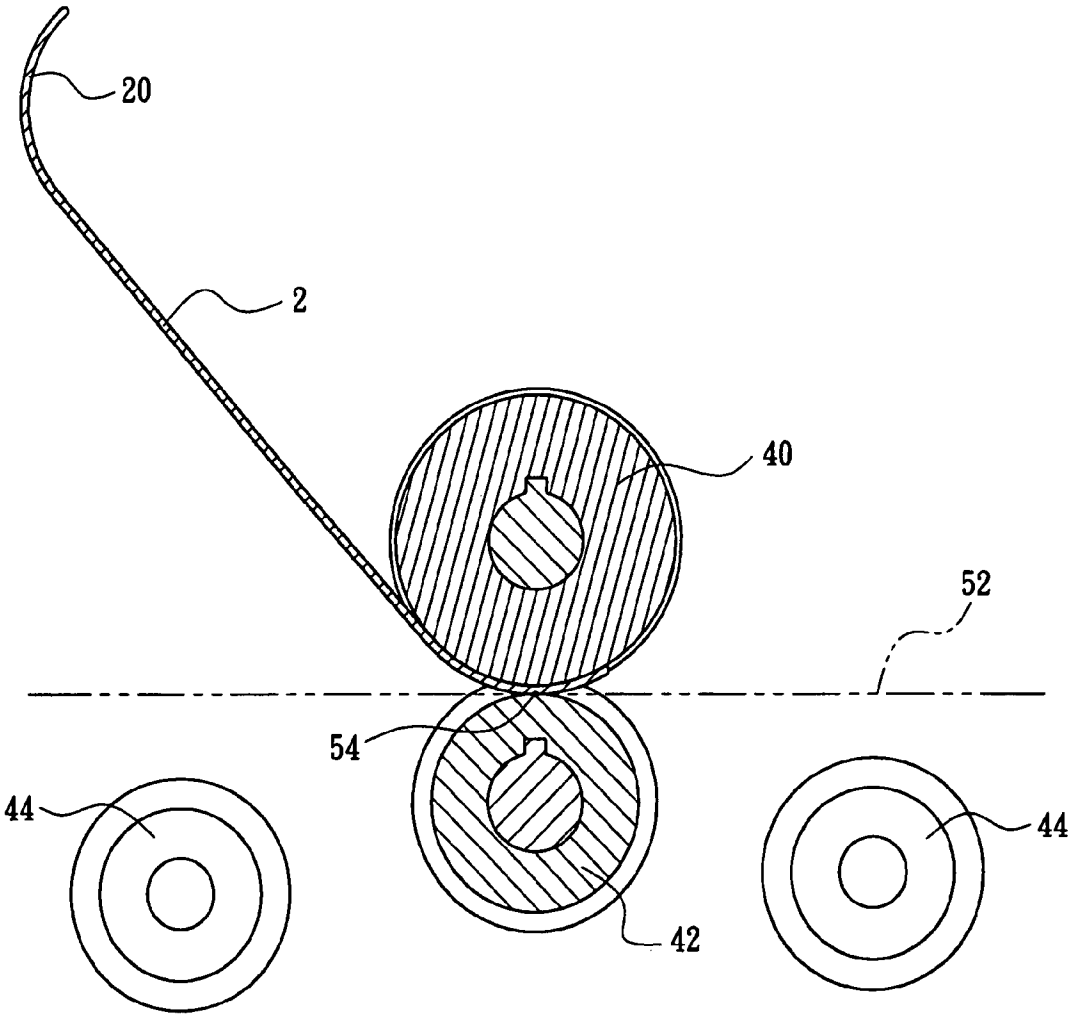
FIG. 9 is a perspective view showing said blank being bent according to the present invention.
Figure 10:
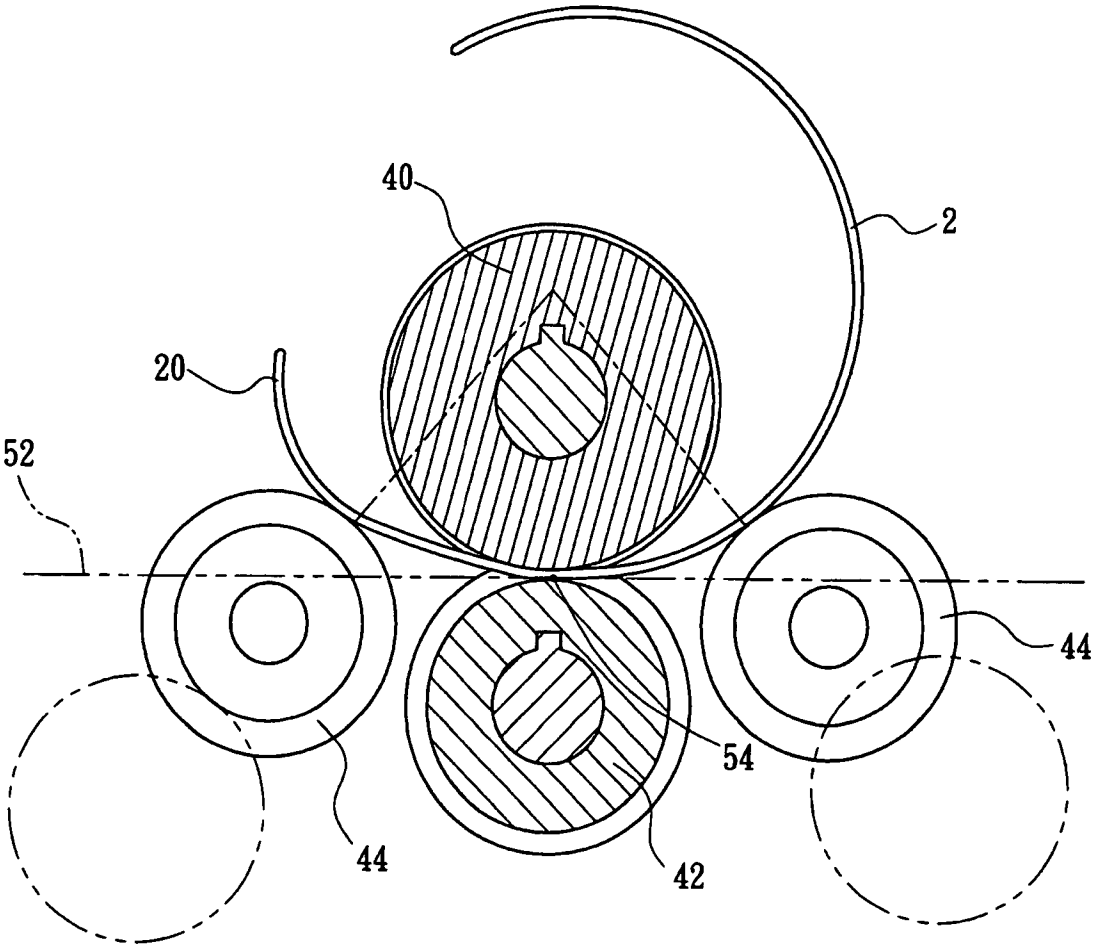
FIG. 10 is a second perspective view showing said blank being bent according to the present invention.

Refer to FIG. 8 for said preferred embodiment. After said blank 2 is pre-curved, in order to assure proper joining of the two ends of said blank 2 and an even weld line 22 between them when said blank 2 is coiled into a circular wheel, said arcs 20 are cut with a sawing machine into an adequate length. Then said ends are chamfered to form a pre-determined outer guide angle 24 and a pre-determined inner guide angle 26 so that when said blank 2 is coiled into a circular wheel, the weld line 22 formed by the two joining ends is in an "X" shape.

Refer to FIG. 8 again for said preferred embodiment. Said outer guide angle 24 and said inner guide angle 26 can be designed to fit the requirements of an actual process. Said outer guide angle 24 is preferably at 30 degrees and said inner guide angle is preferably at 15 degrees so that when said blank 2 is successfully coiled into a round aluminum alloy wheel, the weld line 22 at said joining two ends is in an "X" shape with a wider gap on the outside edge and a narrower gap on the inside edge, making it easier for aluminum alloy solder at said weld line 22 to fuse the surfaces of the two ends of said blank 2 together.

Refer to FIG. 9 to FIG. 12 for said preferred embodiment. When one end of said blank 2 is placed between said upper main roller 40 and said lower main roller 42, move said lower main roller 42 toward said upper main roller 40 to form said holding point 54 and a tangent line 52 passing said holding point 54 so that said arc 20 of said end is held securely between said upper main roller 40 and said lower main roller 42. Then approach said two auxiliary rollers 44 toward said upper main roller 40 from the sides of said upper main roller 40 and said lower main roller 42 until the outer edges of said auxiliary rollers 44 cross said tangent line 52, then drive said upper main roller 40 and said lower main roller 42 simultaneously to roll toward one side of said upper main roller 40 and said lower main roller 42 and to drive said end of said blank 2 to pass between said upper main roller 40 and said lower main roller 42 so that said arc 20 of said end of said blank 2 makes contact with the outer edge of one of said auxiliary rollers 44 and is continuously bent toward said upper main roller 40 along the outer edge of one of said auxiliary rollers 44. Continue this procedure until the arc 20 at the other end of said blank 2 moves between said upper main roller 40 and said lower main roller 42, then drive said upper main roller 40 and said lower main roller 42 simultaneously to roll toward the other side of said upper main roller 40 and said lower main roller 42 and to drive the other end of said blank 2 to pass between said main rollers so that the arc 20 of said other end makes contact with the outer edge of the other auxiliary roller 44 and is continuously bent toward said upper main roller 40 along the outer edge of one of said other auxiliary roller 44. Repeatedly drive said main rollers 40, 42 in said manner and approach said two auxiliary rollers 44 progressively toward said upper main roller 40 so that said blank 2 is pushed by said main rollers 40, 42 and said auxiliary rollers 40 and is continuously bent to form the shape of said desired aluminum alloy wheel with a weld line 22 between the joining two ends of said blank 2, thereby a semi-finished aluminum alloy wheel 3 is produced.

Figure 11:
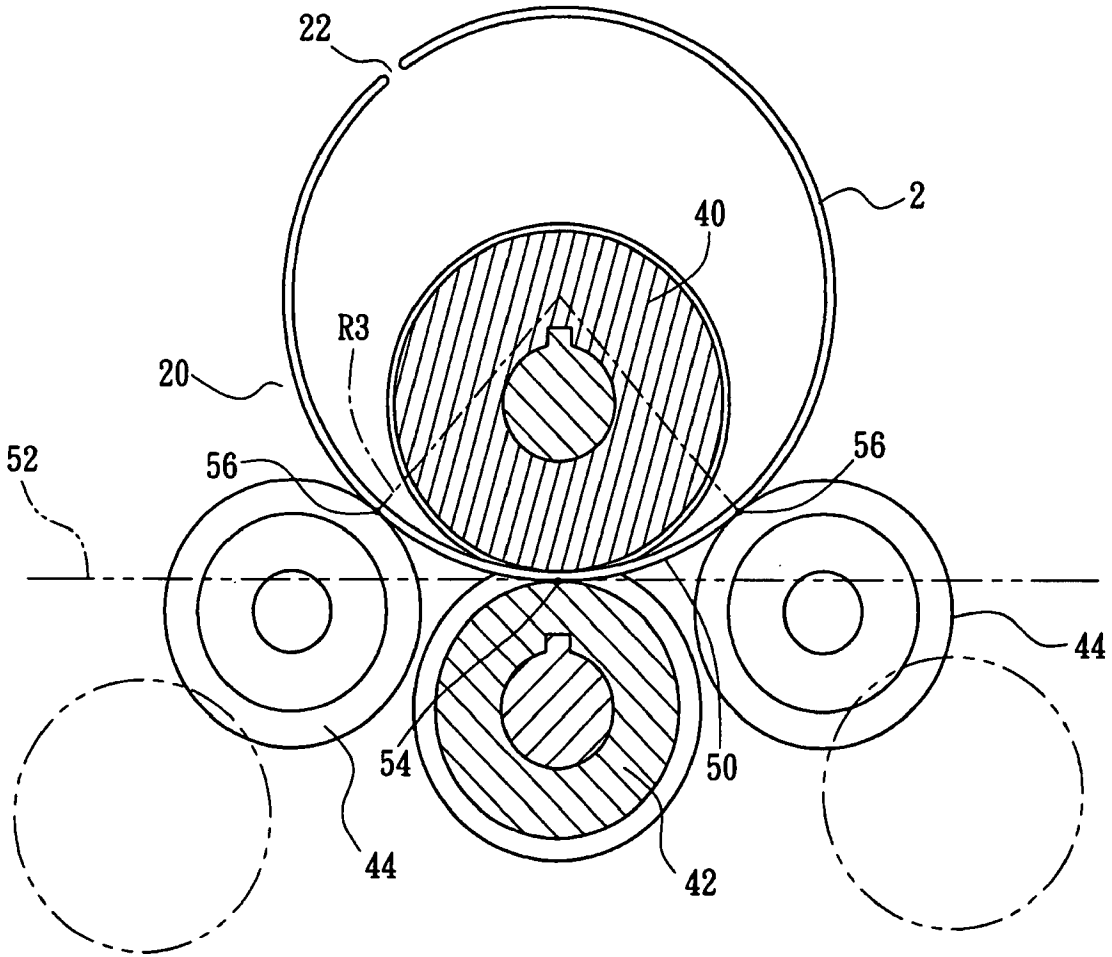
FIG. 11 is a third perspective view showing said blank being bent according to the present invention.
Figure 13:
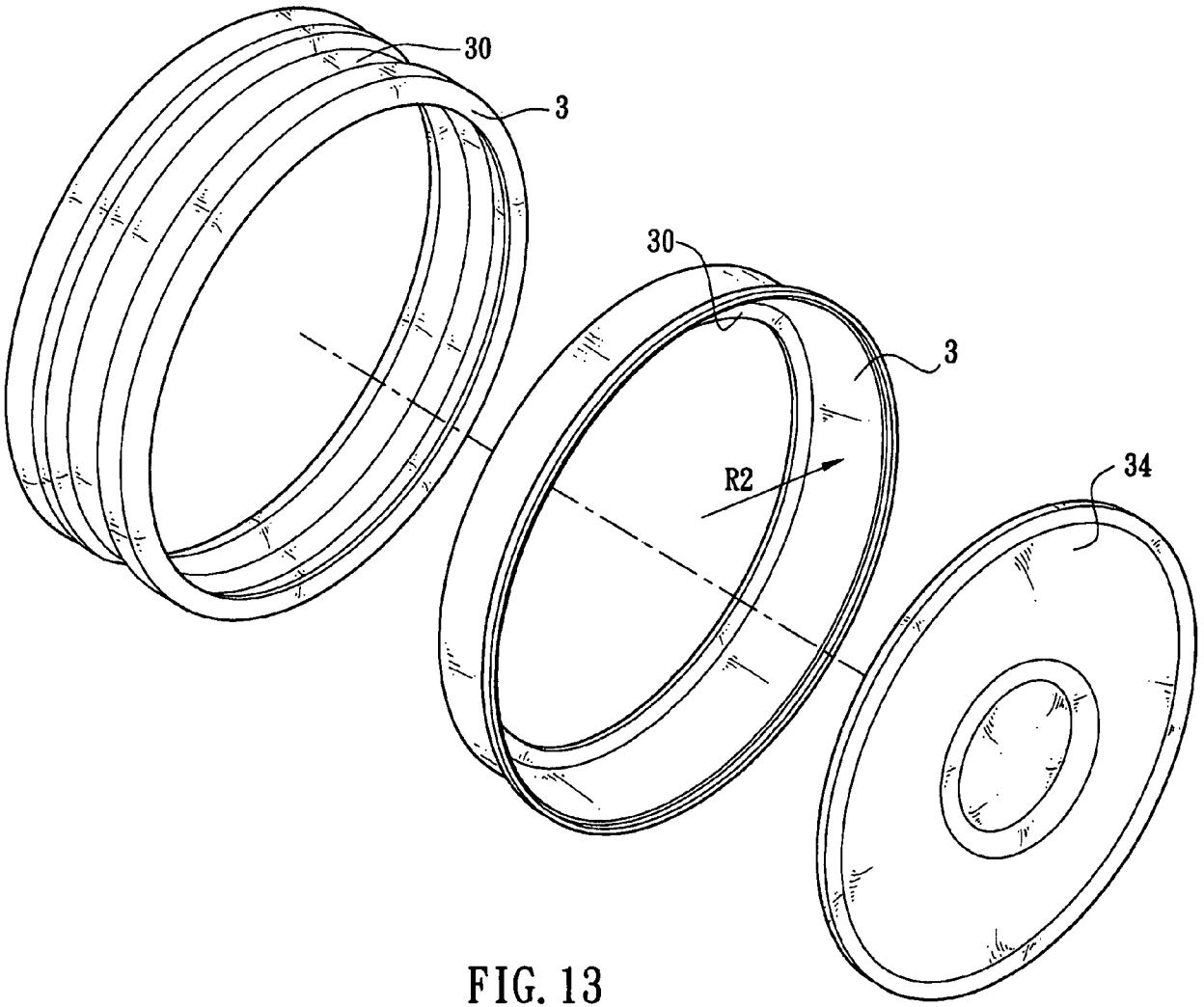
FIG. 13 shows an aluminum alloy wheel and a rim plate according to the present invention.

Refer to FIG. 11 for said preferred embodiment. When said main rollers 40, 42 and said auxiliary rollers 44 complete pushing said blank 2, said holding point 54 and said pushing points 56 at the two outer edges of said two auxiliary rollers 44 form a circular curve 50 on said blank 2, said two outer edges being facing said upper main rollers 40. The radius R3 of said circular curve 50 is same as the radius R2 of the desired aluminum alloy wheel, as shown in FIG. 13. Therefore, by controlling the distance between said two auxiliary rollers 44 and said upper main roller 40, circular curves 50 with various radii can be achieved and semi-finished aluminum alloy wheels 3 with various radii can be produced. As a result, the method according to present invention not only possesses the advantage of a simply working cycle, but also has great flexibility in producing aluminum alloy wheels 3 with different sizes since it does not require various types and sizes of dies as in the prior method.

In the above-mentioned method when said blank 2 is being continuously bent by said main rollers 40, 42 and said auxiliary roller 44, the profile formed by the outer edges of said upper main roller 40 and said lower main roller 42 matches the cross-sectional profile of the desired aluminum alloy wheel, so that said blank 2 can be placed between said upper main roller 40 and said lower main roller 42; the profile on the outer edges of said two auxiliary rollers also matches the cross-sectional profile of the desired aluminum alloy wheel, so that said blank which has the same cross-sectional profile as the desired aluminum alloy wheel can be pushed among said main rollers 40, 42 and said auxiliary rollers 44.

Figure 12:
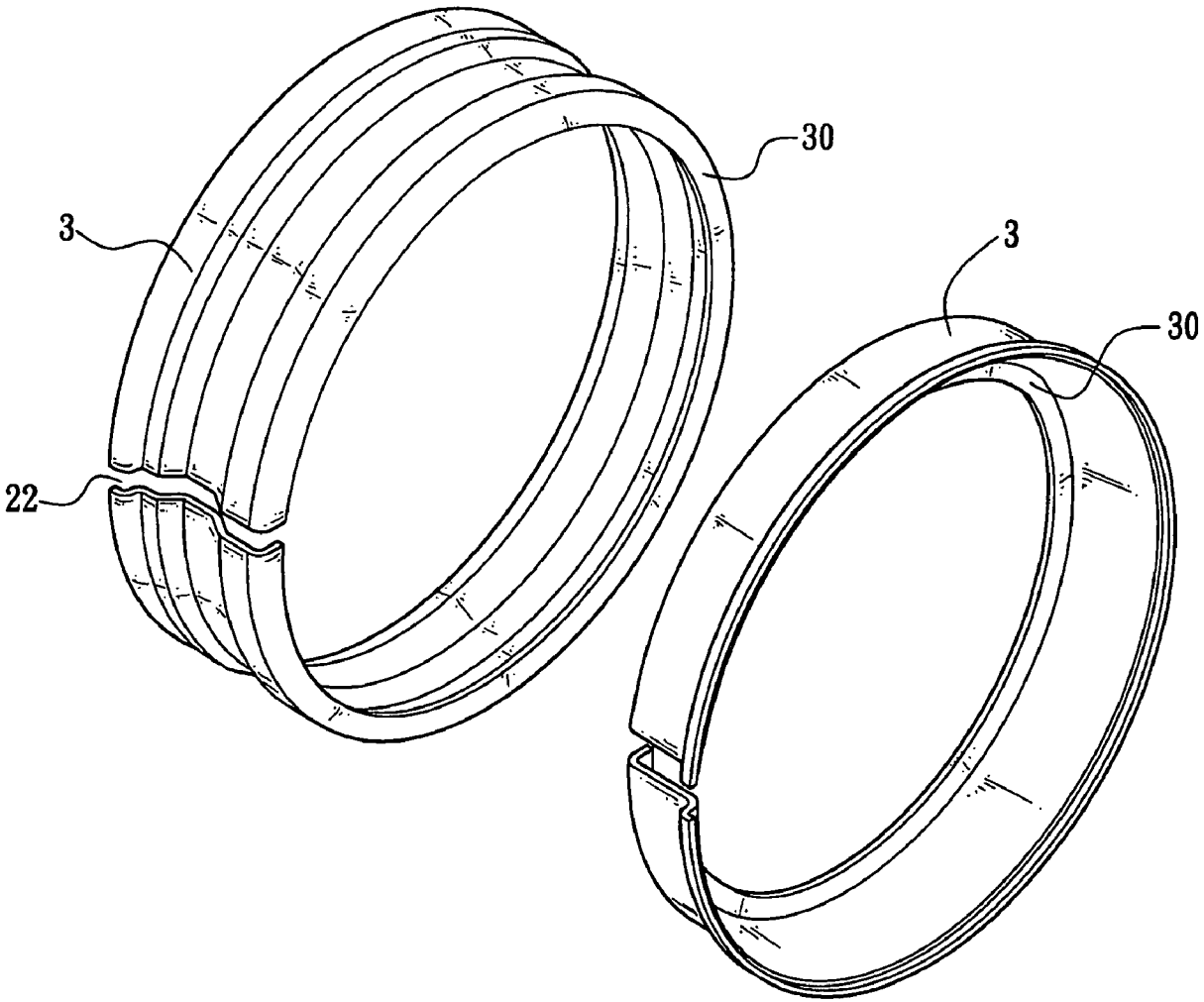
FIG. 12 shows a semi-finished aluminum alloy wheel according to the present invention.

Refer to FIG. 12 for said preferred embodiment. After said blank 2 is pushed and coils into a semi-finished product of the desired aluminum alloy wheel 3, locally point weld the weld line 22 to form a circular wheel. Then place said semi-finished product of the desired aluminum alloy wheel 3 into a welding die to perform melting welding on said weld line 22 so that aluminum alloy solder fuses with the surfaces of the two ends of said blank 2 together to obtain a semi-finished product of the desired aluminum alloy wheel 3.

After said semi-finished product of the desired aluminum alloy wheel 3 is obtained, to eliminate the thermal stress concentration due to the welding, and to facilitate even distribution and close bonding of the molecular structure in the aluminum alloy wheel 3, a solution heat treatment is performed to said aluminum alloy wheel 3. At the completion of the solution heat treatment, said semi-finished product of the desired aluminum alloy wheel 3 is then placed in a press for a shaping operation to correct the error on the aluminum alloy wheel 3 incurred during the forming process and to achieve the exact shapes in the inner and outer edges as the desired wheel. A lathe turning operation is then conducted to truncate the bumps on the surface of the outer edge of said semi-finished product of the desired aluminum alloy wheel 3 and provide an even and smooth surface on said outer edge.

Figure 14:
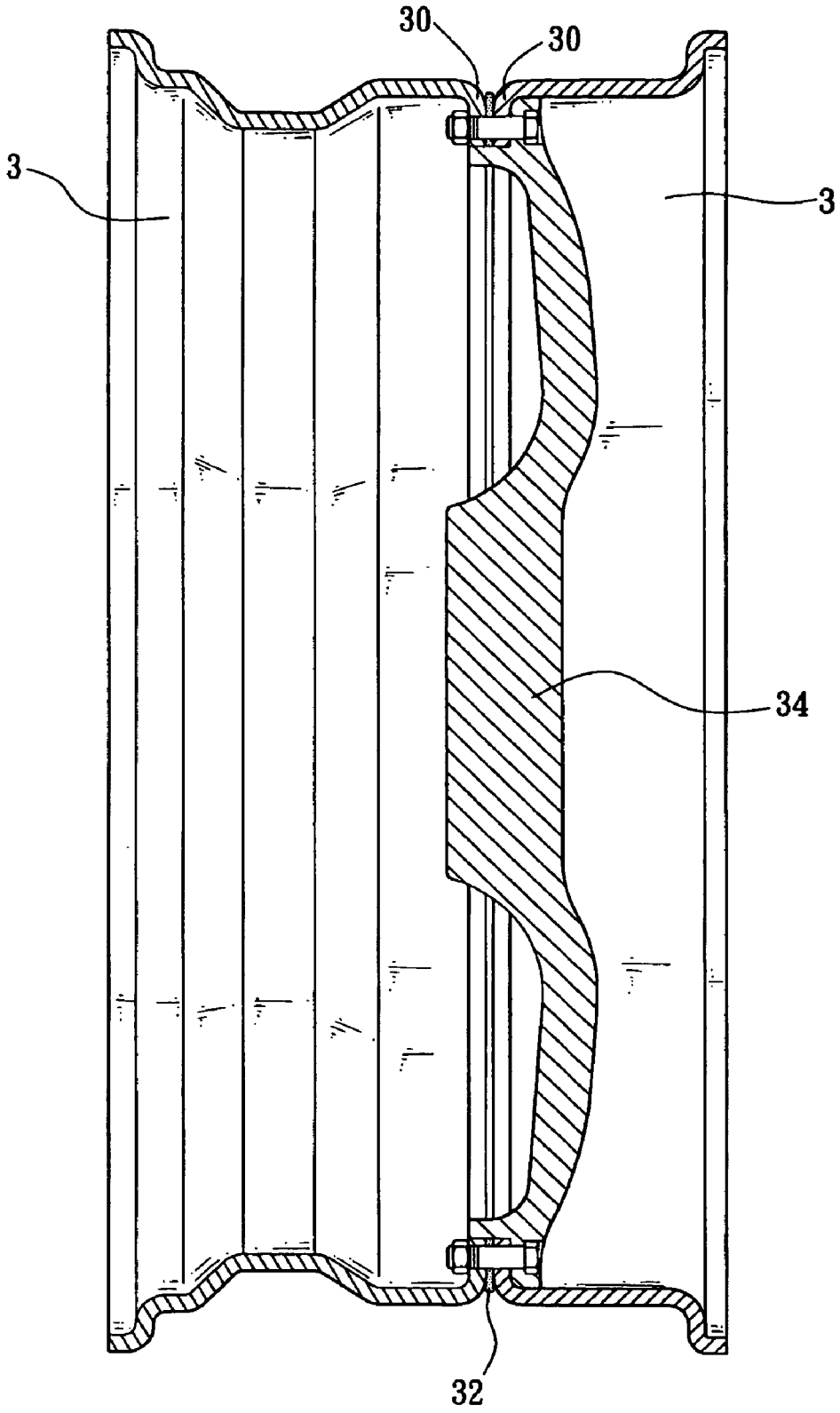
FIG. 14 is a cross-sectional view showing the aluminum alloy wheel and the rim plate according to the present invention.

Refer to FIG. 13 and FIG. 14 for said preferred embodiment. Said aluminum alloy wheel 3 has a plurality of symmetrical screw holes on a rib ring 30 along the inner edge on one side of said aluminum alloy wheel, whereby two of said aluminum alloy wheels having said rib ring 30 and a rim plate 34 capable of coupling to a hub can be integrally secured onto said screw holes via a plurality of securing devices. This not only avoids complex welding processes, it effectively improves the structural strength of said aluminum alloy wheel 3 by means of said rib ring 30.

Refer to FIG. 13 and FIG. 14 again for said preferred embodiment. A rubber washer 32 is inserted and secured between the respective sides of said rib rings 30 of said two aluminum alloy wheels 3 when integrally securing said aluminum alloy wheels 3 with said rim plate 34. By adding said rubber washer 32, air leakage from the tire via the seam between said two rib rings 30 can be prevented when a tire is installed onto said aluminum alloy wheel 3.

From the aforementioned, it is understood that the method of manufacturing an aluminum alloy wheel according to the present invention achieves the following improvements and purposes.

1. The method according to the present invention does not require wheel dies, nor does it require numerous sets of rollers, therefore saves the cost in purchasing those expensive machines and spare good amount of factory space.
2. The method according to the present invention produces said aluminum alloy wheel by continuously pushing and bending, it does not require steps of rolling deformation, therefore avoids a complex working cycle and an unbalanced weight or a low hardness on the resulting aluminum alloy wheel 3 due to an uneven pressure applied during the deformation process.
3. With the method according to the present invention, the size of the desired aluminum alloy wheel 3 can be easily adjusted and large sized aluminum alloy wheels 3 can be produced, therefore provides great flexibility in manufacturing.
4. When adjusting for a different sized aluminum alloy wheel 3, no machinery or procedure has to be changed or replaced, therefore greatly shortens the time in switching the process and totally avoids the danger associated with the prior methods in changing the wheel dies.

While the invention herein disclosed has been described by means of specific embodiments, numerous modifications and variations could be made thereto by those skilled in the art without departing from the scope and spirit of the invention set forth in the claims.

What is claimed is:

1. A method of manufacturing an aluminum alloy wheel, comprising the steps of:

according to the desired cross-sectional profile of said wheel, producing an elongated strip of alloy blank by squeezing an alloy material, pre-curving the two ends of said blank into arcs, placing one end of said blank between an upper main roller and a lower main roller of a rolling machine to hold said blank, the outer edge profile of said upper main roller and the outer edge of said lower main roller matching the inner edge profile and outer edge profile of said desired aluminum alloy wheel, respectively, when said blank is being held by said upper main roller and said lower main roller and being driven back and forth along the longitudinal direction, approaching two auxiliary rollers of said rolling machine toward the two sides of said upper main roller to push said blank, said two auxiliary rollers having an outer edge profile matching the outer edge profile of said blank, so that said blank follows the curve established by a holding point between said upper main roller and said lower main roller and pushing points of said auxiliary rollers to progressively coil into the shape of the desired aluminum alloy wheel, and welding the weld line between the joining two ends of said coiled blank.

2. The method of manufacturing an aluminum alloy wheel of claim 1, wherein after said blank is squeezed, one end of said blank is held between said upper main roller and said lower main roller, and one of said two auxiliary rollers approaches said upper main roller, said main rollers then drive said blank to pass said end between said main rollers toward said auxiliary roller, said end of said bank is thereby pushed by said main rollers and said auxiliary roller to form one of said desired arc.

3. The method of manufacturing an aluminum alloy wheel of claim 2, wherein the radius of said arc is slightly bigger than or at least equal to the radius of said desired aluminum alloy wheel.

4. The method of manufacturing an aluminum alloy wheel of claim 3, wherein when one end of said blank is placed between said upper main roller and said lower main roller, move said lower main roller toward said upper main roller to form said holding point and a tangent line passing said holding point so that said arc of said end is held securely between said main rollers, then approach said two auxiliary rollers toward said upper main roller from the sides of said main rollers until the outer edges of said auxiliary rollers cross said tangent line, then drive said main rollers simultaneously to roll toward one side of said main rollers and to drive said end of said blank to pass between said main rollers so that said arc of said end makes contact with the outer edge of one of said auxiliary rollers and is continuously bent toward said upper main roller along the outer edge of one of said auxiliary rollers, when the arc at the other end of said blank moves between said main rollers, then drive said main rollers simultaneously to roll toward the other side of said main rollers and to drive the other end of said blank to pass between said main rollers so that the arc of said other end makes contact with the outer edge of the other auxiliary roller and is continuously bent toward said upper main roller along the outer edge of one of said other auxiliary roller, repeatedly drive said main rollers in said manner and approach said two auxiliary rollers progressively so that said blank is pushed by said main rollers and said auxiliary rollers and is continuously bent to form the shape of said desired aluminum alloy wheel with a weld line between the joining two ends of said blank, thereby a semi-finished aluminum alloy wheel is produced.

5. The method of manufacturing an aluminum alloy wheel of claim 4, wherein when said main rollers and said auxiliary rollers complete pushing said blank, said holding point and said pushing points at the two outer edges of said two auxiliary rollers form a circular curve on said blank, said two outer edges being facing said upper main rollers.

6. The method of manufacturing an aluminum alloy wheel of claim 5, wherein the radius of said circular curve is same as the radius of said desired aluminum alloy wheel.

7. The method of manufacturing an aluminum alloy wheel of claim 5, wherein when said two auxiliary rollers are driven to roll when making contact with said arcs.

8. The method of manufacturing an aluminum alloy wheel of claim 5, wherein when said main rollers are driven by said rolling machine, said two auxiliary rollers are driven at the same time by said rolling machine.

9. The method of manufacturing an aluminum alloy wheel of claim 5, wherein said aluminum alloy wheel has a plurality of symmetrical screw holes on a rib ring along the inner edge on one side of said aluminum alloy wheel, whereby two of said aluminum alloy wheels having said rib ring and a rim plate capable of coupling to a hub can be integrally secured onto said screw holes via a plurality of securing devices.

10. The method of manufacturing an aluminum alloy wheel of claim 9, wherein a rubber washer is inserted and secured between the respective sides of said rib rings of said two aluminum alloy wheels when integrally securing said aluminum alloy wheels with said rim plate.

11. The method of manufacturing an aluminum alloy wheel of claim 2, wherein after said blank is pre-curved, said arcs are cut with a sawing machine into an adequate length, and then said ends are chamfered to obtain a pre-determined outer guide angle and a pre-determined inner guide angle.

12. The method of manufacturing an aluminum alloy wheel of claim 11, wherein said outer guide angle is preferably at 30 degrees and said inner guide angle is preferably at 15 degrees.

* * * * *